US011525288B2

(12) United States Patent
Schiffer et al.

(10) Patent No.: US 11,525,288 B2
(45) Date of Patent: Dec. 13, 2022

(54) MOTOR VEHICLE LOCKING SYSTEM WITH AN ELECTRICAL OPENING DEVICE

(71) Applicant: Kiekert AG, Heiligenhaus (DE)

(72) Inventors: Holger Schiffer, Meerbusch (DE); Michael Scholz, Essen (DE); Ömer Inan, Dorsten (DE); Michael Herrmann, Neukirchen-Vluyn (DE)

(73) Assignee: Kiekert AG, Heiligenhaus (DE)

( * ) Notice: Subject to any disclaimer, the term of this patent is extended or adjusted under 35 U.S.C. 154(b) by 98 days.

(21) Appl. No.: 16/757,448

(22) PCT Filed: Oct. 18, 2018

(86) PCT No.: PCT/DE2018/100857

§ 371 (c)(1),
(2) Date: Apr. 20, 2020

(87) PCT Pub. No.: WO2019/076409

PCT Pub. Date: Apr. 25, 2019

(65) Prior Publication Data

US 2021/0189775 A1 Jun. 24, 2021

(30) Foreign Application Priority Data

Oct. 20, 2017 (DE) ..... 10 2017 124 517.0

(51) Int. Cl.
*E05B 81/14* (2014.01)
*E05B 81/06* (2014.01)
(Continued)

(52) U.S. Cl.
CPC ..... *E05B 81/14* (2013.01); *E05B 81/06* (2013.01); *E05B 81/34* (2013.01); *E05B 81/42* (2013.01); *E05B 81/50* (2013.01); *E05B 85/26* (2013.01)

(58) Field of Classification Search
CPC ..... E05B 81/06; E05B 81/14; E05B 81/24; E05B 81/26; E05B 81/30; E05B 81/32;
(Continued)

(56) References Cited

U.S. PATENT DOCUMENTS 6,390,517 B1 5/2002 Ehret
6,557,911 B2 * 5/2003 Nelsen ..... E05B 81/14 292/201
(Continued)

FOREIGN PATENT DOCUMENTS

DE 19913666 A1 9/2000
DE 19948052 A1 4/2001
(Continued)

OTHER PUBLICATIONS

Translation of International Search Report dated Jan. 17, 2019 for PCT/DE2018/100857.

*Primary Examiner* — Kristina R Fulton
*Assistant Examiner* — Noah Horowitz
(74) *Attorney, Agent, or Firm* — Renner, Otto, Boisselle & Sklar, LLP

(57) ABSTRACT

A motor vehicle locking system for a door or hatch, comprising a locking mechanism with a rotary latch and a pawl for latching the rotary latch, a drive pulley for an electrical opening means, which drive pulley can be rotated in a motorized manner in an operating direction for tripping the locking mechanism, and a return spring for rotating the drive pulley in the direction opposite the operating direction, wherein the drive pulley can be rotated in the operating direction without being influenced by the return spring or at least without spring load. Therefore, higher loads can be moved by the drive pulley.

17 Claims, 1 Drawing Sheet

(51) Int. Cl.

| | |
|---|---|
| ***E05B 81/34*** | (2014.01) |
| ***E05B 81/42*** | (2014.01) |
| ***E05B 81/50*** | (2014.01) |
| ***E05B 85/26*** | (2014.01) |

(58) Field of Classification Search

CPC ..... E05B 81/34; E05B 81/42; E05B 81/48; E05B 81/50; E05B 85/20; E05B 85/24; E05B 85/243; E05B 85/26; Y10T 292/1047; Y10T 292/1078; Y10T 292/1082; Y10S 292/23

See application file for complete search history.

(56) References Cited

U.S. PATENT DOCUMENTS

| | | | | |
|---|---|---|---|---|
| 6,565,131 | B2 | 5/2003 | Roos | |
| 6,988,749 | B2 * | 1/2006 | Hashiba | E05B 81/14 292/201 |
| 7,152,890 | B2 * | 12/2006 | Torkowski | E05B 81/14 292/201 |
| 7,438,330 | B2 * | 10/2008 | Takahashi | E05B 81/25 292/201 |
| 7,766,397 | B2 * | 8/2010 | Carabalona | E05B 81/14 292/201 |
| 8,448,999 | B2 * | 5/2013 | Grifoll Sauri | E05B 81/14 292/216 |
| 9,551,172 | B2 | 1/2017 | Barmscheidt | |
| 9,677,305 | B2 | 6/2017 | Bendel | |
| 9,863,169 | B2 * | 1/2018 | Barmscheidt | E05B 85/01 |
| 10,745,944 | B2 * | 8/2020 | Bendel | E05B 81/06 |
| 2002/0167177 | A1 * | 11/2002 | Erices | E05B 85/02 292/201 |
| 2005/0093685 | A1 * | 5/2005 | Kachouh | B60N 2/888 340/438 |

FOREIGN PATENT DOCUMENTS

| | | | |
|---|---|---|---|
| DE | 19828040 | B4 | 5/2005 |
| DE | 102012003743 | A1 | 8/2013 |
| EP | 1225290 | B1 | 7/2006 |
| EP | 2133497 | A1 | 12/2009 |
| WO | 2012119581 | A2 | 9/2012 |
| WO | 2012137808 | A1 | 10/2012 |

* cited by examiner

MOTOR VEHICLE LOCKING SYSTEM WITH AN ELECTRICAL OPENING DEVICE

FIELD OF INVENTION

The invention relates to a motor vehicle locking system for a door or flap, comprising a locking mechanism having a catch and a pawl for latching the catch, a drive pulley for an electrical opening means which can be rotated, in a motorized manner, in an operating direction, in order to trigger the locking mechanism, and a return spring for rotating the drive pulley in the direction counter to the operating direction.

BACKGROUND OF INVENTION

Motor vehicle locking systems are used for reliably closing the door or flap of a motor vehicle, such that the door or flap cannot open unintentionally, in particular during travel.

Today, motor vehicle locking systems are increasingly designed so as to be motorized and automatic, such that for example opening the latch, or pulling shut said latch in a closing manner, no longer requires manual effort.

In systems of this kind, the drive force of an electrical motor is frequently used on a lever, via a rotatable coupling means, for example for releasing, i.e. unlatching and opening, the locking mechanism. A return spring is provided in some systems, in order to rotate the coupling means back again, even without an electrical drive force, for example after the locking mechanism has been triggered. Reference is made to EP01225290 B1, DE19828040 B4, DE102012003743 A1 and WO2012119581 A2, in which a return spring is used for retraction.

However, according to the prior art and the cited documents, the return spring is always tensioned from the start of an operating movement, in order for the coupling means, such as a driven pulley, to be rotated back into the initial position thereof again, by means of the return spring.

SUMMARY OF INVENTION

The above-mentioned features known from the prior art can be combined, individually or in any desired combination, with one of the subjects according to the invention described in the following.

The object of the invention is that of providing a developed motor vehicle locking system for a door or flap.

In order to achieve this object, a motor vehicle locking system for a door or flap according to the present disclosure is used. Advantageous embodiments can be found in the present disclosure.

In order to achieve the object, a motor vehicle locking system for a door or flap is used, comprising a locking mechanism having a catch and a pawl for latching the catch, a drive pulley for an electrical opening means which can be rotated, in a motorized manner, in an operating direction, in order to trigger the locking mechanism, and a return spring for rotating the drive pulley in the direction counter to the operating direction, it being possible for the drive pulley to be rotated in the operating direction without influence by the return spring, or at least without spring load.

A motor vehicle locking system is used for reliably closing the door or flap of a motor vehicle, such that the door or flap cannot open unintentionally, in particular during travel.

A locking mechanism that is provided for closing a door or flap substantially consists of the catch and the pawl. The catch can be pivoted from an open position into a closed position, using a locking pin of a door or flap. In the closed position, the pawl latches the catch. The locking pin can then no longer leave the locking mechanism, since the catch can then no longer be pivoted back into the open position thereof.

For the purpose of opening, the pawl must first be moved out of the ratchet position thereof, i.e. lifted from the catch. Subsequently, the catch can rotate back into the open position thereof. The locking pin can then leave the locking mechanism, and an associated door or flap can be opened.

In particular, two ratchet positions are provided, specifically what is known as pre-ratchet position and a main ratchet position. If the catch is latched in the pre-ratchet position, the associated door or flap is not yet completely closed. The catch can then be rotated further in the direction of the main ratchet position, in order to be latched in the main ratchet position. An associated door or flap is then completely closed. Rotating the catch from the pre-ratchet position into the main ratchet position can be achieved in a motorized manner, in particular using an electrical closing aid which can preferably be combined with an electrical opening means or can optionally also be provided as a common means.

The locking mechanism is unlatched, i.e. released, using an operating means. In particular a release lever of the locking mechanism is used for pivoting the pawl in order to release the locking mechanism. If an associated operating means is operated, then a locking mechanism of a door or flap that is connected thereto is unlatched, i.e. opened. The associated door or flap can then be opened. Release can be achieved in a motorized manner, in particular using the electrical opening means.

A motor vehicle locking system can furthermore be locked. In the locked state, a locking mechanism can no longer be opened from the outside, by operating an outside operating element, such as an outside door handle. In order to provide improved protection against theft, locking is also carried out in such a manner that opening is no longer possible by operating an inside operating element either. When engaged, a child safety lock prevents a rear door of the motor vehicle from being able to be opened from the interior. The latching, unlatching, engagement or disengagement of an anti-theft device or child safety lock can be achieved in a motorized manner, using a or the electrical means.

Drive pulley is intended to mean a pulley which can bring about operation of the locking mechanism, in particular by means of rotation. The drive pulley is preferably driven by an electrical drive. The electrical drive preferably comprises an electric motor and/or a worm drive which, in the simplest case, may be a worm. The drive pulley preferably comprises teeth, preferably on the periphery of the pulley, which teeth are in particular suitable for interacting with a worm, in order to form a worm drive.

Rotated in a motorized manner means rotated by an electrical drive, for example. Alternatively or in addition, however, it may also be possible to provide for rotation of the drive pulley by means of manual force.

In particular, the drive pulley is rotated from a basic position, in which the pawl can drop into the catch or be latched by means of the catch, in the operating direction, in order to release the locking mechanism.

In particular, the drive pulley is rotated in the operating direction as far as an end position, in which the pawl can no longer latch together with the catch. In principle, upon reaching the end position of the drive pulley or a region close to the end position, the pawl is released or pivoted for release. In particular, in the end position the pawl can no longer be pivoted for latching. In order to allow for a new closing process in this case, the drive pulley is reset or rotated back, counter to the operating direction. In normal operation, the resetting or rotation back preferably takes place in a motorized manner, and in particular into the basic position.

Resetting or rotation back preferably takes place by means of the return spring only in emergency operation, and in particular not fully back into the basic position. A return spring for rotating the drive pulley in the direction counter to the operating direction in general means a spring which is designed such that, by means of the spring force, spring tension or spring energy thereof, the drive pulley can be rotated counter to the operating direction. The return spring is preferably a torsion spring.

Rotating the drive pulley in the operating direction without influence by the return spring means without any braking effect by means of a spring force of the return spring.

In other words, rotation in the operating direction without influence by the return spring means that the spring force, spring tension or spring energy of the return spring does not correlate with a braking force opposing a rotation of the drive pulley in the operating direction. A braking force or braking effect of this kind can result, for example, from friction or sliding friction of the return spring on the drive pulley, in the force direction of the spring force of the return spring.

Simply touching, resting or sliding of the return spring on the drive pulley in the event of a rotation in the operating direction, for example owing to a compact design, is not an influence on the rotation of the drive pulley provided that the direction of action of the spring force does not extend through the contact point or the contact surface, such that a higher spring force would lead to a higher frictional force.

Rotating the drive pulley in the operating direction without spring loading means without an opposing torque from a spring, in particular a return spring.

The drive pulley can therefore rotate without having to work against a spring or the return spring in the process. In principle, when a spring load is present, the rotation of the drive pulley is coupled with a spring deflection. Specifically, in general, in the conventional systems, the return spring is always simultaneously pretensioned, in the event of a rotation of the coupling means, for example out of an initial position, in the operating direction, in order to rotate the coupling means back into the initial position, by means of the spring pretension thus built up, following release of the locking mechanism. For example, this build up of the spring preload causes a spring load within the meaning above.

Since the drive pulley can be rotated in the operating direction without influence by the return spring or at least without spring load, the rotational resistance that is otherwise present is reduced, and an improved acceleration of the drive pulley is made possible. Thus, particularly high dynamics can be achieved in the system. Higher loads can be moved in this manner, which loads could not be moved, or could not be moved with such dynamics, i.e. such rapidity and acceleration behavior, in conventional systems having an equally powerful electric motor. An electrical opening means thus makes it possible for the drive pulley and/or the release lever to be able to gain momentum quasi unimpeded, in order to knock the pawl out of the latching with the catch, or to release it therefrom.

This effect can also be achieved if the rotational range of the drive pulley for gaining momentum without spring load, also referred to in the following as freewheel or freewheel rotational angle range, follows a rotational range under spring load for pretensioning the return spring, also referred to in the following as spring load rotational angle range, before the end position for releasing the locking mechanism is reached. In particular, the spring load rotational angle range and the freewheel rotational angle range directly adjoin one another, and form the overall rotational angle range which extends from the basic position as far as the end position of the drive pulley.

In one embodiment, the drive pulley can be rotated within a freewheel rotational angle range without influence by the return spring, or at least without a spring load, in the operating direction, and/or the freewheel rotational angle range is at least 30°, preferably at least 45°, and/or at most 180°, preferably at most 90°.

An in particular predetermined freewheel rotational angle range makes it possible to set a desired dynamic of the system.

A freewheel rotational angle range of at least 30° causes an effective gain of momentum. A freewheel rotational angle range of at most 180° allows for a particularly simple design. A freewheel rotational angle range of at most 90° additionally allows for a particularly short operating time.

In one embodiment, the drive pulley can be rotated within a freewheel rotational angle range, under spring load, in the operating direction, and/or the spring load rotational angle range is at least 90°, preferably at least 110°, and/or at most 180°, preferably at most 150°.

An in particular predetermined spring load rotational angle range makes it possible for the return spring to be preloaded, for the purpose of subsequently rotating back the drive pulley. In the case of a spring load rotational angle range of at least 90°, a particularly simply designed operating means is sufficient for being able to reliably release the locking mechanism. A spring load rotational angle range of at most 180° reduces the operating time.

A freewheel-rotational angle range of approximately 60°, and/or a spring load-rotational angle range of approximately 130°, is particularly preferred. It is thereby possible to achieve a maximum effectiveness with respect to the load movement.

In one embodiment, the operating means is configured such that the return spring rotates the drive pulley back, counter to the operating direction, only in emergency operation.

The operating means comprises the drive pulley as well as, in principle, also the electrical drive and/or the lever.

In emergency operation, normal operation is no longer possible. In particular, in emergency operation motorized rotation or rotation back of the drive pulley is not possible. In particular, in emergency operation, the power supply has failed, or the electrical drive is faulty.

The change from normal operation into emergency operation is preferably associated with an additional condition, according to which the locking mechanism is open, i.e. is in an open position of the catch. This is because if, in this position, the drive pulley is not rotated back, the pawl is held in a pivot position, from which engagement and latching of the pawl with the catch is not possible, in the event of rotation of the catch into the pre-ratchet position or main ratchet position.

However, since, in emergency operation, the return spring rotates the drive pulley back, the drive pulley can be rotated back by the return spring, and thus closure of the locking mechanism can still be made possible, even in the event of power failures, for example.

In one embodiment, the operating means is configured such that, in normal operation, the drive pulley is rotated in a motorized manner from a basic position, in the operating direction, in order to release the locking mechanism, and/or is rotated back, in a motorized manner, in the direction counter to the operating direction, into the basic position.

Motorized rotation in the operating direction, from the basic position, in particular into the end position, ensures motorized release of the locking mechanism, and thus a particularly high degree of comfort in normal operation.

Rotation back into the basic position in a motorized manner brings about a particularly effective gain in momentum for the freewheeling without spring load, and thus a particularly advantageous dynamic of the system.

In particular, the drive pulley cannot be rotated beyond the basic position, in the direction counter to the operating direction. The basic position thus preferably represents a limitation of the overall rotational angle range, i.e. the total rotational angle range, in the direction counter to the operating direction.

A limitation of this kind can be achieved for example by means of a mechanical stop. Alternatively or in addition, a drive pulley rotational position control means can be provided, which comprises a rotational position sensor and a control unit for controlling the electrical drive. It is then possible, in particular, for the control unit to be configured such that a rotation back, counter to the operating direction, from the basic position, is blocked.

In particular, the end position constitutes the other limitation of the total rotational angle range, the end position following the basic position, in the operating direction.

In one embodiment, the freewheel rotational angle range, which is limited in the operating direction by the freewheel end position, in particular directly follows the basic position, in the operating direction, and/or the spring load rotational angle range directly follows the freewheel rotational angle range, in the operating direction.

The freewheel rotational angle range, i.e. the freewheel, following the basic position, allows for a particularly effective gain in momentum. The spring load rotational angle range directly following the freewheel rotational angle range allows for an improved gain in momentum, compared with the reverse case or a different arrangement.

In particular, the freewheel rotational angle range is limited and/or defined by the basic position of the drive pulley and the freewheel end position. In particular, the spring load rotational angle range is limited and/or defined by the freewheel end position and the end position.

In one embodiment, the drive pulley comprises a carrier for carrying along the return spring for pre-tensioning the return spring, upon rotation of the drive pulley in the operating direction.

Carrying along the return spring means carrying along a free part of the return spring which, in the event of deflection with respect to a fixed part of the return spring, leads to pre-tensioning of the return spring.

In particular, the fixed part of the return spring is essentially fastened to a stationary housing, preferably so as to be immobile, at least in the direction of a deflection of the return spring carried along by the carrier in the event of rotation of the drive pulley in and counter to the operating direction.

In one embodiment, the carrier is a cam or tappet.

This allows for the return spring to be carried along in a particularly precise and definable manner, when a predetermined rotational angle of the drive pulley is reached, in particular in a freewheel end position.

In one embodiment, the carrier can carry along the return spring, in the operating direction, only into a freewheel end position that limits the freewheel rotational angle range in the operating direction, and/or the return spring can rotate the drive pulley back, in the direction counter to the operating direction, only approximately as far as the freewheel end position.

In other words, the carrier can thus carry along the return spring only following rotation about the freewheel rotational angle range, in the operating direction.

Thus, when the operating means is activated for operation of the locking mechanism by the user, the drive pulley thus moves, together with the carrier, in particular out of the basic position, in a motorized manner, but will not carry along the return spring immediately, but only after the predefined freewheel rotational angle range of the drive pulley. As a result, momentum can be achieved particularly advantageously, and improved dynamics of the system can be achieved.

Since the return spring is pretensioned only from the freewheel end position, by rotation in the operating direction, the return spring can in principle also rotate the drive pulley back only as far as the freewheel end position, following release of the locking mechanism.

In one embodiment, in the basic position of the drive pulley and/or in the freewheel end position of the drive pulley, the pawl can latch together with the catch, and/or in an end position of the drive pulley the pawl cannot latch together with the catch.

In particular, the situation is the same, here, if the catch is moved out of an opening position, by an incorporated locking pin, into a ratchet position, i.e. in principle into the pre-ratchet position or the main ratchet position, in which the locking mechanism assumes a closed state only if the pawl drops into the catch, and thus latches together with the catch. If, however, the pawl is held in a released position, due to positioning of the drive pulley in the end position, engagement upon reaching the catch, in the ratchet position, is blocked by the drive pulley or a control contour of the drive pulley. In this case, the door or flap could no longer be reliably closed.

Since, in the basic position of the drive pulley, the pawl can latch together with the catch, particularly reliable normal operation is made possible. Since, in the freewheel end position of the drive pulley, the pawl can latch together with the catch, particularly reliable emergency operation is made possible. Since, in the end position of the drive pulley, the pawl cannot latch together with the catch, i.e. is held in the release position, particularly reliable release of the locking mechanism is made possible.

In one embodiment, the drive pulley comprises a control contour for a lever for releasing the locking mechanism, or forms said control contour, such that the lever can be pivoted, depending on the rotational angle position of the drive pulley, by means of rotating the drive pulley and thus the control contour.

It is thus possible to use a particularly simply designed electrical opening means.

In one embodiment, the control contour protrudes on an axial surface of the drive pulley, and/or, upon rotation of the drive pulley, the lever can slide in particular radially along the control contour, and/or can be pressed onto the control contour, in particular radially, by means of a lever spring.

In this way, particularly dynamic interaction with the lever can be achieved, in particular by means of the radial contact point or radial support.

The radius of the control contour preferably increases continually, towards the drive pulley axis of rotation, and/or substantially constantly, the rotational angle, preferably starting at or after the basic position. The control contour is preferably helical and/or extends helically in the radial direction, in particular from the drive pulley axis of rotation. In particular, the radius of the control contour increases over an angular range of less than 180°.

In particular, the lever pivot axis is oriented so as to be in parallel with the drive pulley axis of rotation. The lever is preferably elongate, and pivotably mounted in the center.

In one embodiment, the lever is the pawl, or the lever is movably coupled to the pawl such that pivoting of the lever can lead to pivoting of the pawl, and/or vice versa.

In particular, the lever is directly coupled to the pawl. Preferably, the lever is coupled to the pawl by means of a release lever and/or further mechanical components. The motor vehicle locking system can thus be adjusted to the available installation space in a particularly optimized manner.

In one embodiment, the operating means is designed such that, in the event of a rotation of the drive pulley in the operating direction, the lever is pivoted before or after the return spring is carried along.

The first alternative, i.e. before the return spring is carried along, thus allows for a particularly short operation time to be achieved.

The second alternative, i.e. after the return spring is carried along, thus makes it possible to achieve particularly high dynamics in the system.

In one embodiment, the drive pulley is a gearwheel or a worm wheel having teeth around the periphery thereof in order to be able to be driven by an electric drive.

As a result, particularly effective force transmission from an electric motor is possible, in a small space.

BRIEF DESCRIPTION OF DRAWINGS

Exemplary embodiments of the invention will be explained in greater detail in the following, with reference to the figures. Features of the exemplary embodiments can be combined, individually or as a plurality.

In the figures.

DETAILED DESCRIPTION

Figure 1:
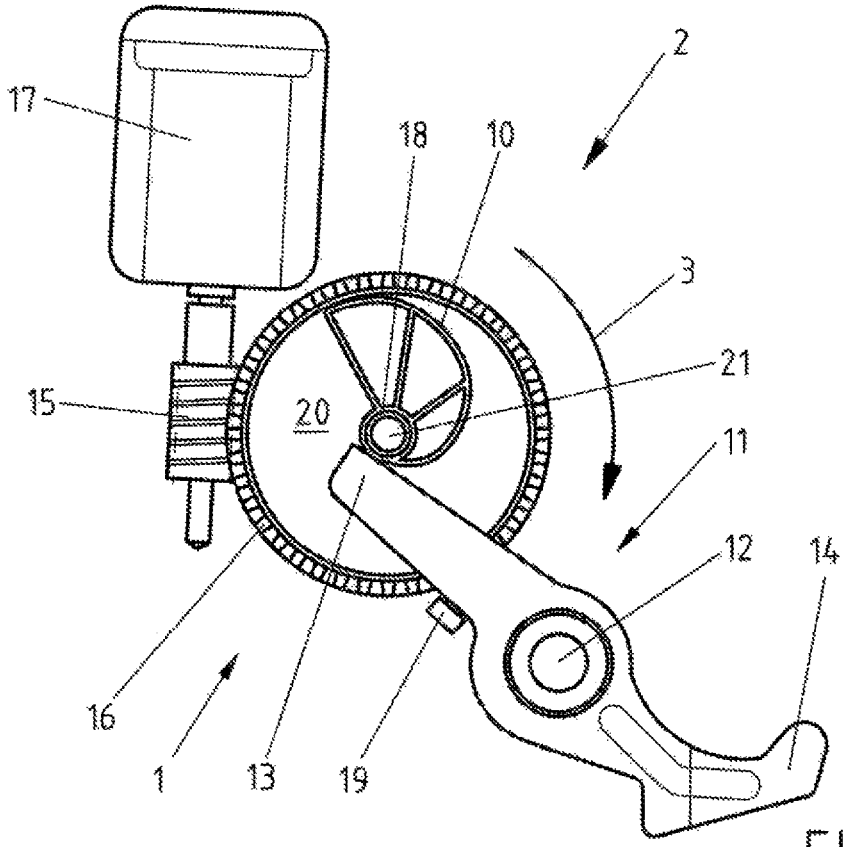
FIG. 1: is a schematic view of a drive pulley that can be rotated in a motorized manner, that acts on a locking mechanism (not shown) by means of a lever, and that can be rotated back by means of a hidden return spring.

FIG. 1 shows an operating means comprising a drive pulley 1 which can be rotated in a motorized manner by an electric drive comprising an electric motor 17, and which, by means of the rotation, can pivot a lever 11 in order to release a locking mechanism (not shown). In particular a worm drive is provided, in order to transfer the drive torque from the electric motor 17, via a worm 15 and teeth 16, provided on the periphery of the drive pulley 1 and meshing with the worm 15, to the drive pulley 1.

The worm 15 and/or the drive shaft of the electric motor 17 rotate about an axis that is oriented so as to be perpendicular to the drive pulley axis of rotation 21. In contrast, the lever pivot axis 12 is preferably oriented so as to be in parallel with the drive pulley axis of rotation 21. Therefore, a free end 13 of the lever 11 may be moved along an axial surface 20, i.e. a lateral face, of the drive pulley 1. In particular, the free end 13 extends in a manner overlapping with the drive pulley 1 to such an extent that the free end 13 extends from the lever pivot axis 12 as far as the drive pulley axis of rotation 21.

On the surface at which the free end 13 can move over the side face of the drive pulley 1, the drive pulley 1 comprises a protruding, annular collar 18 about the drive pulley axis of rotation 21, for the purpose of rotatable mounting about an axis or a shaft. The free end 13 can therefore rest in particular radially on said annular collar 18, from the outside. Proceeding from an annular segment of the collar 18, a control contour 10 that protrudes beyond the axial surface 20 extends in the radial direction, i.e. in the direction of the outer periphery of the control disc 1.

In one embodiment, the angular range of the annular segment or the angular range of the extension of the control contour 10 in the peripheral direction about the drive pulley axis of rotation 21 is at least 90°, preferably at least 110°, and/or at most 150°, preferably at most 130°. The lower limit ensures reliable release of the locking mechanism, and the upper limit ensures a short operating time.

In one embodiment, the basic position 4 of the drive pulley 1 is provided at or in front of a starting point of the control contour 10, i.e. on the collar 18, such that the starting point of the control contour 10 is achieved only after a particular rotational angle range, in the event of rotation from the basic position 4, in the operating direction 3.

In one embodiment, at the starting point the control contour 10 emerges tangentially from the collar 18.

In other words, at the starting point on the collar 18 the control contour 10 forms a tangential extension of the collar 18. Uniform pivoting of the lever 11 can thus be made possible.

In one embodiment, the end position 6 of the drive pulley 1 is provided at an end point of the control contour 10.

In one embodiment, the control contour 10 strikes the collar 18 perpendicularly, at an end point of the control contour 10. Particularly stable retention of the lever 11 in the release position can thus be made possible.

In one embodiment, the control contour 10 corresponds to a radial peripheral surface of an axial projection on the axial surface 20 of the drive pulley 1.

In particular, the control contour 10 does not protrude radially beyond the outer periphery of the drive pulley 10, on which the teeth 16 are preferably arranged. In particular, fastening means 19 for fastening a spring or a lever spring is provided. The fastening means 19 is preferably arranged between the free end 13 and the lever pivot axis 12.

The free end 13 of the lever 11 is pushed, by the lever spring, in the direction of the drive pulley axis of rotation 21, the collar 18 and/or the control contour 10. The lever 11 can therefore slide along the control contour 10 in the event of rotation of the drive pulley 1, a pivot angle of the lever 11 correlating with the radius of the control contour 10. The opposite end 14 of the lever 11 is designed such that it can release the locking mechanism. If the free end 13 of the lever 11 is located radially to a region of the collar 18 without a control contour 10 therebetween, or is located in the region of the starting point of the control contour 10, the lever 11 can be pivoted essentially counter to the lever spring force, and/or can rise up from the collar 18 or the control contour 10. This is the case in particular if the locking mechanism or the catch is in the open position, and for example the lever 11 is either the pawl or is movably coupled to the pawl in both pivot directions. Specifically, the pawl then has not dropped or latched into the catch, but is instead dragged on the outer periphery of the catch, under spring preload, and drops into the catch only if the catch has been moved into the closed position by a locking pin.

In one embodiment, the locking mechanism is in an open position when the free end 13 of the lever 11 rests directly on the collar 18 or on the control contour 10, in a particular angular range of the starting point.

In one embodiment, the collar 18 is an extension of the control contour 10 or is a part thereof. The collar 18 can thus fulfil a dual function.

In particular, the return spring is arranged on the opposite side (hidden in FIG. 1) of the axial surface 20 of the drive pulley 1. An in particular eccentrically arranged cam is preferably fastened on the opposing side of the axial surface 20 of the drive pulley 1, which cam protrudes axially beyond the opposing side. If, upon rotation in the operating direction 3, the drive pulley 1 has reached the freewheel end position, the cam strikes the return spring or a free part of the return spring for the purpose of carrying along in the operating direction 3.

Figure 2:
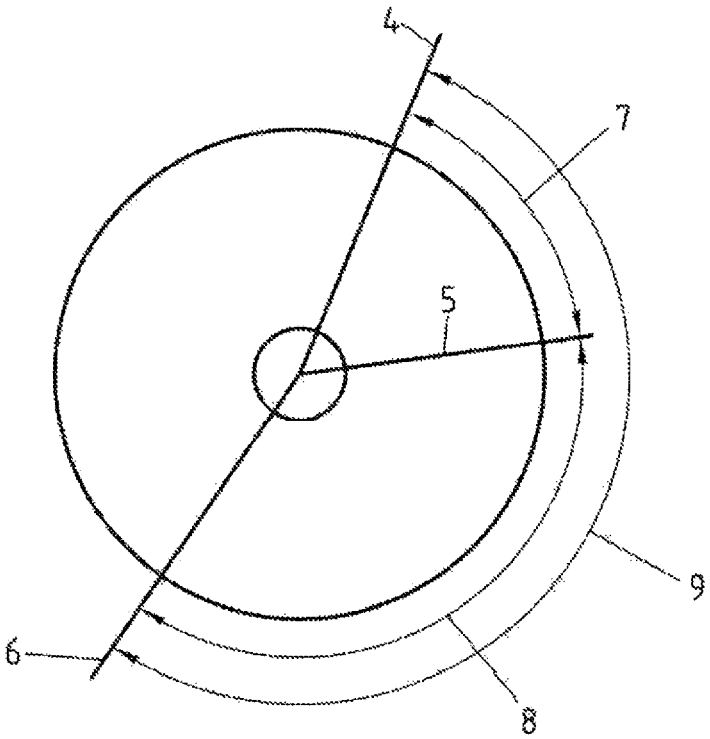
FIG. 2: is a schematic view of the rotational angle ranges of a drive pulley, in particular of the drive pulley shown in FIG. 1.

FIG. 2 shows the rotational angle range of a drive pulley 1 of an operating means, in particular the operating means of FIG. 1.

In normal operation, the drive pulley 1 essentially rests in the basic position 4, as a starting position or prepared position, when the locking mechanism and/or the catch are in the open position or in the closed position. If the operating means, in particular electrical opening means 2, is activated for opening the door or flap, the drive pulley 1 is rotated about the freewheel rotational angle range 7, into the freewheel end position, in a motorized manner, where the return spring is carried along, and rotated further about the spring load rotational angle range 8, into the end position 6, preferably without slowing of the rotational movement, i.e. at a continuous rotational movement. In particular, the drive pulley 1 cannot be rotated beyond the basic position 4 and/or the end position 6, or the operating means is not configured therefor. The basic position 4 and the end position 6 preferably define the total rotational angle range 9 of the operating means. In the end position 6, the lever 11 is already pivoted so far that the locking mechanism is released. Upon release, the pawl is lifted from the catch. In particular, the pivot position and/or the lifted position of the pawl correlates with the rotational angle position of the drive pulley 1, such that, in the end position of the drive pulley 1 the pawl can no longer drop into the catch for the purpose of latching, even if the catch reaches the closed position, in a subsequent opening and closing cycle, in order to be latched there, by means of the pawl.

However, in order that the pawl can latch the catch, as planned, in the closed position, in a subsequent opening and closing cycle, the drive pulley is rotated back, counter to the operating direction 3 into the basic position 4, in a motorized manner, in normal operation, and/or approximately into the freewheel end position, by means of the return spring, in emergency operation.

In one embodiment, the pawl assumes a first ratchet deflection for latching together with the catch, in the closed position, when the drive pulley is in the basic position 4.

In a further embodiment, the pawl assumes a second ratchet deflection for latching together with the catch, in the closed position, when the drive pulley is in the freewheel end position 5, the first ratchet deflection differing from the second ratchet deflection. In particular, there are two different, planned, contact ratchet points, which are associated with the first and second ratchet deflection, respectively.

In the following, an opening and closing cycle of the locking mechanism in normal operation, and the difference from emergency operation, are described.

The locking mechanism is in an open position. In normal operation, the drive pulley 1 has been rotated into the basic position 4, in a motorized manner.

The pawl rests on the periphery of the catch in a spring-preloaded manner. A locking pin rotates the catch into the closed position. The pawl drops into the catch under a spring preload, and latches together with the catch. The locking mechanism is then reliably closed.

The user activates the operating means for opening the locking mechanism, in order that the door or flap can be opened.

The drive pulley 1 is rotated from the basic position 4 into the end position 6, in a motorized manner, the return spring being carried along by the drive pulley 1 in the rotational angle position of the freewheel end position 5.

Prior to the spring being carried along, freewheeling of the drive pulley 1 from the basic position 4 takes place, i.e. rotation without influence by the return spring and without spring load, i.e. unbraked rotation in order to achieve momentum.

Carrying the return spring along between the freewheel end position 5 and the end position 6 causes the return spring to be pretensioned.

When the end position 6 is reached, the lever 11 has been pivoted into a release position, and the pawl has thus been lifted from the catch, such that the catch is rotated back, out of the closed position and into the open position, in particular by means of a catch spring.

In normal operation, the drive pulley is then rotated back into the basic position 4, essentially independently of the return spring, in order to be ready for the next opening and closing cycle.

However, if the power fails in this situation, then the return spring brings about the rotation back of the drive pulley 1, but not back into the basic position 4, but instead back into the freewheel end position 5. However, since the pawl no longer remains raised in the release position, simply when the drive pulley 1 is rotated back into the freewheel end position 5, the pawl can be lowered, in a subsequent opening and closing cycle, in order to latch together with the catch in the closed position even in emergency operation, for example without a supply of power from the electric motor 17.

The invention claimed is:

1. A motor vehicle locking system for a door or flap, the motor vehicle locking system comprising:

a locking mechanism having a catch and a pawl for latching the catch, an electric motor, a drive pulley for an electrical opening means, wherein the drive pulley can be rotated, in a motorized manner by the electric motor, in an operating direction from a basic position to an end position to trigger the locking mechanism, and a return spring for rotating the drive pulley in a second direction counter to the operating direction, wherein the drive pulley is rotated in the operating direction without influence by the return spring or any spring load to a freewheel end position between the initial position and the end position;

wherein:

during a normal operation the drive pulley is rotated in the motorized manner by the electric motor from the basic position to the end position in the operating direction to release the locking mechanism, and the drive pulley is rotated back in the motorized manner by the electric motor in the second direction counter to the operating direction to the basic position; and during an emergency operation in which there is no power to the electric motor, the return spring rotates the drive pulley back in the second direction counter to the operating direction to the freewheel end position.

2. The motor vehicle locking system according to claim 1, wherein the freewheel end position has a freewheel rotational angle range relative to the basic position that is at least 30° and at most 180°.

3. The motor vehicle locking system according to claim 2, wherein a spring load rotational angle range during which the spring is loaded directly adjoins the freewheel rotational angle range in the operating direction.

4. The motor vehicle locking system according to claim 2, wherein the drive pulley comprises a carrier for carrying along the return spring for pre-tensioning the return spring, upon rotation of the drive pulley in the operating direction.

5. The motor vehicle locking system according to claim 4, wherein the carrier is a cam or a tappet.

6. The motor vehicle locking system according to claim 4, wherein the carrier can carry along the return spring, in the operating direction, only into a freewheel end position that limits the freewheel rotational angle range in the operating direction, and the return spring can rotate the drive pulley back in the second direction counter to the operating direction only as far as the freewheel end position.

7. The motor vehicle locking system according to claim 1, wherein, in the basic position and in the freewheel end position of the drive pulley the pawl can latch together with the catch, and in thean end position of the drive pulley the pawl cannot latch together with the catch.

8. The motor vehicle locking system according to claim 1, wherein the drive pulley comprises or forms a control contour for a lever for releasing the locking mechanism, wherein the lever can be pivoted, depending on a rotational angle position of the drive pulley, by rotating the drive pulley and thus the control contour.

9. The motor vehicle locking system according to claim 8, wherein the control contour protrudes on an axial surface of the drive pulley, and the lever can slide along the control contour radially during rotation of the drive pulley.

10. The motor vehicle locking system according to claim 8, wherein the lever is the pawl or is movably coupled to the pawl whereby pivoting of the lever can lead to pivoting of the pawl.

11. The motor vehicle locking system according to claim 8, wherein during a rotation of the drive pulley in the operating direction, the lever is pivoted before or after the return spring is carried along.

12. The motor vehicle locking system according to claim 1, wherein the drive pulley is a gearwheel or a worm wheel having teeth around the periphery thereof in order to be able to be driven by the electric motor.

13. The motor vehicle locking system according to claim 2, wherein the freewheel rotational angle range is at most 90°.

14. The motor vehicle locking system according to claim 2, wherein the freewheel rotational angle range is at least 90° and/or at most 180°.

15. The motor vehicle locking system according to claim 8, wherein a lever pivot axis of the lever is oriented to be parallel with a drive pulley axis of rotation of the drive pulley.

16. The motor vehicle locking system according to claim 8, wherein a free end of the lever is movable along a lateral face of the drive pulley.

17. The motor vehicle locking system according to claim 16, wherein the drive pulley includes a protruding annular collar arranged about a drive pulley axis of rotation of the drive pulley, wherein the free end rests radially on the protruding annular collar.

* * * * *